US010060288B2

(12) United States Patent
Romanov et al.

(10) Patent No.: US 10,060,288 B2
(45) Date of Patent: Aug. 28, 2018

(54) MULTI-FLOW COOLING PASSAGE CHAMBER FOR GAS TURBINE ENGINE

(71) Applicant: United Technologies Corporation, Farmington, CT (US)

(72) Inventors: Dmitriy A. Romanov, Wells, ME (US); Paul M. Lutjen, Kennebunkport, ME (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 259 days.

(21) Appl. No.: 14/879,416

(22) Filed: Oct. 9, 2015

(65) Prior Publication Data

US 2017/0101889 A1 Apr. 13, 2017

(51) Int. Cl.
*F01D 25/12* (2006.01)
*F01D 11/08* (2006.01)
(Continued)

(52) U.S. Cl.
CPC ..... *F01D 25/12* (2013.01); *F01D 11/08* (2013.01); *F01D 11/12* (2013.01); *F01D 11/24* (2013.01);
(Continued)

(58) Field of Classification Search
CPC ..... F05D 2240/81; F05D 2240/10; F05D 2240/80; F05D 2260/20; F01D 11/08;
(Continued)

(56) References Cited

U.S. PATENT DOCUMENTS 7,255,536 B2 * 8/2007 Cunha ..... F01D 9/02 416/193 A
7,650,926 B2 * 1/2010 Tholen ..... B22C 9/04 164/35
(Continued)

FOREIGN PATENT DOCUMENTS

| | | |
|---|---|---|
| EP | 1520960 | 4/2005 |
| EP | 3006669 | 4/2016 |
| WO | 2015130380 A2 | 9/2015 |

OTHER PUBLICATIONS

European Search Report, European Application No. 16183419.7, dated Feb. 8, 2017, European atent Office; European Search Report 9 pages.

*Primary Examiner* — Woody Lee, Jr.
*Assistant Examiner* — Sang K Kim
(74) *Attorney, Agent, or Firm* — Cantor Colburn LLP

(57) ABSTRACT

A cooling chamber in a gas turbine engine includes a first side surface, a second side surface, a bottom surface, and a top surface defining a chamber therein. The second side surface is angled at a first angle with respect to the first side surface, the chamber having an inlet end and an exit located downstream of the inlet end, wherein the chamber has a width that narrows from the inlet end toward the exit. An inlet is located in one of the top surface or the bottom surface at the inlet end of the chamber. At least one divider is located within the chamber, the at least one divider configured to separate an airflow flowing from the inlet to the exit into a first airflow and a second airflow. The at least one divider is angled at a second angle with respect to the first side surface.

16 Claims, 6 Drawing Sheets

(51) Int. Cl.
*F01D 11/12* (2006.01)
*F01D 11/24* (2006.01)

(52) U.S. Cl.
CPC ..... *F05D 2220/32* (2013.01); *F05D 2230/50* (2013.01); *F05D 2240/11* (2013.01); *F05D 2240/307* (2013.01); *F05D 2240/81* (2013.01); *F05D 2260/20* (2013.01)

(58) Field of Classification Search
CPC ..... F01D 11/12; F01D 11/24; F01D 25/12; F01D 9/04; F05B 2240/11; F05B 2240/801
See application file for complete search history.

(56) References Cited

U.S. PATENT DOCUMENTS

| | | | | |
|---|---|---|---|---|
| 8,177,492 | B2 | 5/2012 | Knapp et al. | |
| 8,317,461 | B2 | 11/2012 | Tholen et al. | |
| 8,814,518 | B2 * | 8/2014 | Harris, Jr. ..... | F01D 5/081 29/557 |
| 2010/0054914 | A1 | 3/2010 | Tholen et al. | |
| 2015/0159488 | A1 * | 6/2015 | Lehmann ..... | F01D 5/18 416/1 |

* cited by examiner

MULTI-FLOW COOLING PASSAGE CHAMBER FOR GAS TURBINE ENGINE

STATEMENT REGARDING FEDERALLY SPONSORED RESEARCH OR DEVELOPMENT

This invention was made with government support under Contract No. FA8650-09-D-2923 0021 awarded by the U.S. Air Force. The government may have certain rights in the invention.

BACKGROUND

The subject matter disclosed herein generally relates to cooling chambers in components of gas turbine engines and, more particularly, to an improved cooling chamber of a component of a gas turbine engine.

Gas turbine engines are known and typically include a compressor section compressing air and delivering it into a combustion section. The air is mixed with fuel in the combustion section and ignited. Products of the combustion pass downstream over turbine rotors, driving the turbine rotors.

A number of components are utilized in gas turbine engines to control the flow of the products of combustion such that they are directed along desired flow paths. One such component is called a blade outer air seal. A blade outer air seal sits slightly radially outwardly of an outer tip of a turbine blade in a turbine rotor, which is driven to rotate by the products of combustion. By having the blade outer air seal closely spaced from the rotor, leakage of the products of combustion around the turbine rotor is reduced.

The blade outer air seals are subject to very high temperature. Thus, cooling air may be supplied through the blade outer air seal to counter the high temperature. Cooling air from a source of air cooler than the product of combustion is circulated through channels in the blade outer air seal. The channels may be thin in a radial dimension. As the channel becomes thinner relative to an axial width of the channel, the flow characteristics of the cooling air may degrade. That is, when an aspect ratio of a circumferentially-flowing channel (where the aspect ratio is the radial dimension divided by the axial dimension), is relatively high, then there is good circulation of air and desirable heat transfer characteristics. On the other hand, as the aspect ratio drops, which occurs as the (radial) height of the channel becomes smaller, the heat transfer effectiveness may decrease and/or friction losses may increase. Having a thinner radial dimension is desirable to enable higher cooling effectiveness for the same amount of air flow, or achieving the same cooling effectiveness with reduced air flow.

Multiple channels may be arranged adjacent to each other, around a circumference of a rotor or other disk that includes airfoils. To maintain consistent heat flux along the length of the channel, in the airflow direction, the channel may have a tapered width, i.e., a direction normal to the airflow direction.

An aspect ratio of a circumferentially-flowing channel (where the aspect ratio is the radial dimension divided by the axial dimension, i.e., channel height divided by channel width), is relatively high, then there is good circulation of air and desirable heat transfer characteristics. On the other hand, as the aspect ratio drops, which occurs as the (radial) height of the channel becomes smaller, the heat transfer effectiveness may decrease and/or friction losses may increase. Having a thinner radial dimension is desirable to enable higher cooling effectiveness for the same amount of air flow, or achieving the same cooling effectiveness with reduced air flow. In certain situations, there may be minimum and maximum allowed height-to-width ratios, due to tolerances and forces imposed on the disks during operation. Accordingly, high tapering angles, e.g., channels with large widths, may be difficult to implement. Thus, improved multi-flow chambers for cooling that enable large channel widths and low heights is desirable.

SUMMARY

According to one embodiment, a cooling chamber in a gas turbine engine includes a first side surface, a second side surface opposing the first side surface, a bottom surface, and a top surface opposing the bottom surface, the surfaces defining a chamber therein. The second side surface is angled at a first angle with respect to the first side surface, the chamber having an inlet end and an exit located downstream of the inlet end, wherein the chamber has a width that narrows from the inlet end toward the exit. An inlet is located in one of the top surface or the bottom surface at the inlet end of the chamber. At least one divider is located within the chamber, the at least one divider configured to separate an airflow flowing from the inlet to the exit into a first airflow and a second airflow. The at least one divider is angled at a second angle with respect to the first side surface.

In addition to one or more of the features described above, or as an alternative, further embodiments of the cooling chamber may include that the at least one divider comprises a first divider and a second divider.

In addition to one or more of the features described above, or as an alternative, further embodiments of the cooling chamber may include that the first divider and the second divider are aligned in a direction extending from the inlet toward the exit, wherein a gap separates the first divider from the second divider.

In addition to one or more of the features described above, or as an alternative, further embodiments of the cooling chamber may include that the first divider and the second divider are offset from the second angle by a misalignment angle.

In addition to one or more of the features described above, or as an alternative, further embodiments of the cooling chamber may include that the inlet is a first inlet, the seal segment further comprising a second inlet located adjacent the first inlet at the inlet end of the chamber, wherein the at least one divider is located between the first inlet and the second inlet and an airflow from the first inlet provides the first airflow and the second inlet provides the second airflow.

In addition to one or more of the features described above, or as an alternative, further embodiments of the cooling chamber may include a third inlet located adjacent the second inlet at the inlet end, wherein a first divider is located between the first inlet and the second inlet and a second divider is located between the second inlet and the third inlet.

In addition to one or more of the features described above, or as an alternative, further embodiments of the cooling chamber may include that the second angle is equal to half of the first angle.

In addition to one or more of the features described above, or as an alternative, further embodiments of the cooling chamber may include that the at least one divider extends from an end wall of the chamber at the inlet end of the chamber.

In addition to one or more of the features described above, or as an alternative, further embodiments of the cooling chamber may include that the at least one divider tapers in a direction extending from the inlet end to the exit.

In addition to one or more of the features described above, or as an alternative, further embodiments of the cooling chamber may include that the at least one divider has a varying thickness along a direction extending from the inlet end to the exit.

In addition to one or more of the features described above, or as an alternative, further embodiments of the cooling chamber may include that the chamber is a cooling chamber of a seal of a blade outer air seal of the gas turbine engine.

In accordance with another embodiment, a method of forming a cooling chamber for a gas turbine engine is provided. The method includes forming a chamber defined by a first side surface and a second side surface opposing the first side surface and a bottom surface and a top surface opposing the bottom surface, the second side surface angled at a first angle with respect to the first side surface, the chamber having an inlet end and an exit located downstream of the inlet end, wherein the chamber has a width that narrows from the inlet end toward the exit, forming an inlet located at the inlet end of the chamber, and forming at least one divider located in the chamber, the at least one divider configured to separate an airflow in the chamber into a first airflow and a second airflow. The at least one divider is angled at a second angle with respect to the first side surface.

In addition to one or more of the features described above, or as an alternative, further embodiments of the method may include installing the seal segment into a gas turbine engine.

In addition to one or more of the features described above, or as an alternative, further embodiments of the method may include that forming the at least one divider comprises forming a first divider and a second divider in the chamber.

In addition to one or more of the features described above, or as an alternative, further embodiments of the method may include that the first divider and the second divider are aligned in a direction extending from the inlet toward the exit, wherein a gap separates the first divider from the second divider.

In addition to one or more of the features described above, or as an alternative, further embodiments of the method may include that the first divider and the second divider are offset from the second angle by a misalignment angle.

In addition to one or more of the features described above, or as an alternative, further embodiments of the method may include that the inlet is a first inlet, the method further comprising forming a second inlet located adjacent the first inlet at the inlet end of the chamber, wherein the at least one divider is formed between the first inlet and the second inlet and an airflow from the first inlet provides the first airflow and the second inlet provides the second airflow.

In addition to one or more of the features described above, or as an alternative, further embodiments of the method may include forming a third inlet adjacent the second inlet at the inlet end, wherein a first divider is formed between the first inlet and the second inlet and a second divider is formed between the second inlet and the third inlet.

In addition to one or more of the features described above, or as an alternative, further embodiments of the method may include that the second angle is equal to half of the first angle.

In addition to one or more of the features described above, or as an alternative, further embodiments of the method may include that the at least one divider extends from an end wall of the chamber at the inlet end of the chamber.

Technical effects of embodiments of the present disclosure include a cooling chamber within a seal segment having one or more dividers configured to enable a wide cooling chamber. Further technical effects include divides within a cooling chamber, the dividers configured to separate multiple flow paths within the cooling chamber. Further technical effects include dividers within cooling chambers that maintain flow structure through the cooling chamber while reducing cavity heights for baseline heat transfer coefficient improvements.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
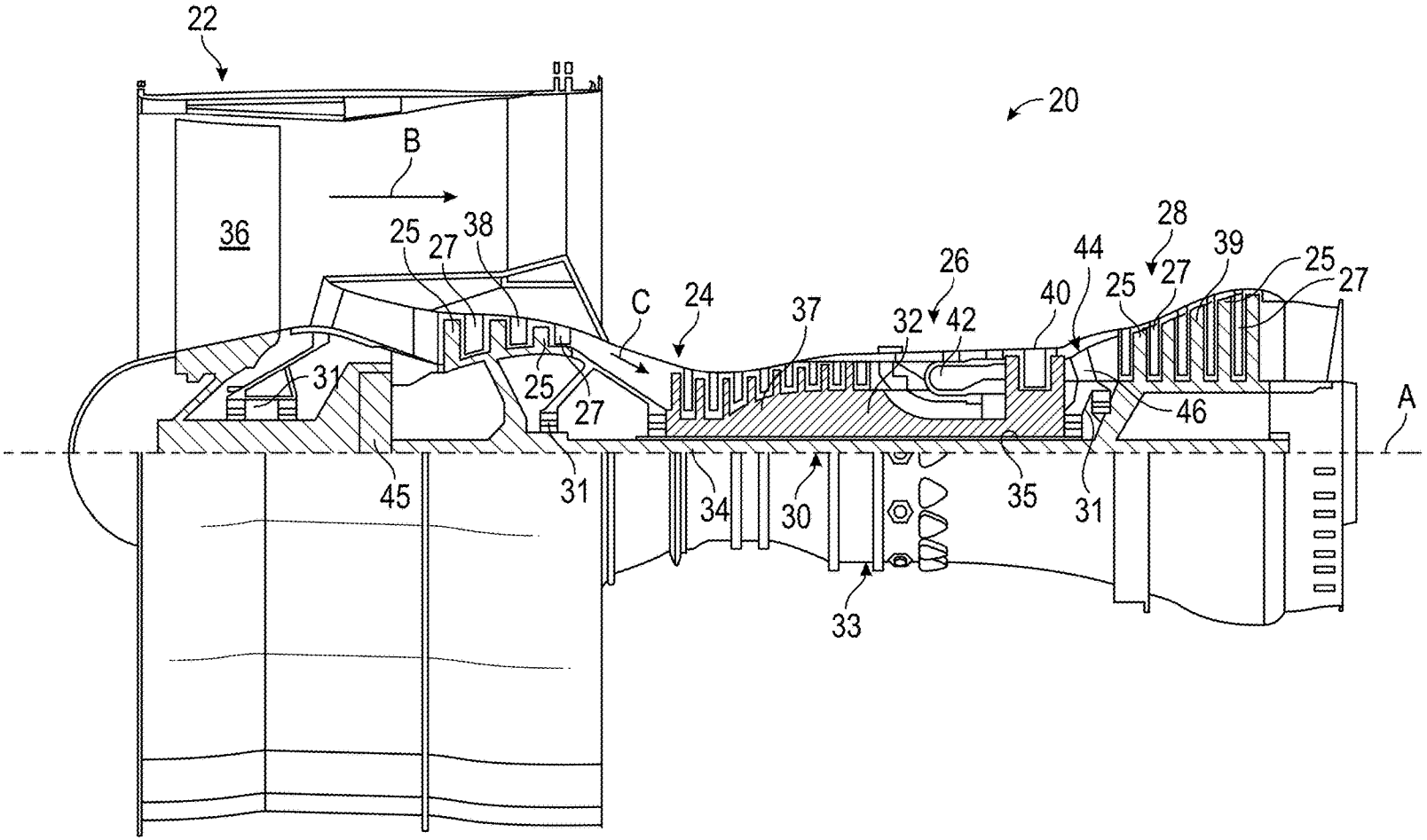
FIG. 1A is a schematic cross-sectional view of a gas turbine engine that may employ various embodiments disclosed herein.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1A schematically illustrates a gas turbine engine 20. The exemplary gas turbine engine 20 is a turbofan engine that generally incorporates a fan section 22, a compressor section 24, a combustor section 26, and a turbine section 28. Alternative engines might include an augmenter section (not shown) among other systems for features. The fan section 22 drives air along a bypass flow path B, while the compressor section 24 drives air along a core flow path C for compression and communication into the combustor section 26. Hot combustion gases generated in the combustor section 26 are expanded through the turbine section 28. Although depicted as a turbofan gas turbine engine in the disclosed non-limiting embodiment, it should be understood that the concepts described herein are not limited to turbofan engines and these teachings could extend to other types of engines, including but not limited to, three-spool engine architectures.

The gas turbine engine 20 generally includes a low speed spool 30 and a high speed spool 32 mounted for rotation about an engine centerline longitudinal axis A. The low speed spool 30 and the high speed spool 32 may be mounted relative to an engine static structure 33 via several bearing systems 31. It should be understood that other bearing systems 31 may alternatively or additionally be provided.

The low speed spool 30 generally includes an inner shaft 34 that interconnects a fan 36, a low pressure compressor 38 and a low pressure turbine 39. The inner shaft 34 can be connected to the fan 36 through a geared architecture 45 to drive the fan 36 at a lower speed than the low speed spool 30. The high speed spool 32 includes an outer shaft 35 that interconnects a high pressure compressor 37 and a high pressure turbine 40. In this embodiment, the inner shaft 34 and the outer shaft 35 are supported at various axial locations by bearing systems 31 positioned within the engine static structure 33.

A combustor 42 is arranged between the high pressure compressor 37 and the high pressure turbine 40. A mid-turbine frame 44 may be arranged generally between the high pressure turbine 40 and the low pressure turbine 39. The mid-turbine frame 44 can support one or more bearing systems 31 of the turbine section 28. The mid-turbine frame 44 may include one or more airfoils 46 that extend within the core flow path C.

The inner shaft 34 and the outer shaft 35 are concentric and rotate via the bearing systems 31 about the engine centerline longitudinal axis A, which is co-linear with their longitudinal axes. The core airflow is compressed by the low pressure compressor 38 and the high pressure compressor 37, is mixed with fuel and burned in the combustor 42, and is then expanded over the high pressure turbine 40 and the low pressure turbine 39. The high pressure turbine 40 and the low pressure turbine 39 rotationally drive the respective high speed spool 32 and the low speed spool 30 in response to the expansion.

Each of the compressor section 24 and the turbine section 28 may include alternating rows of rotor assemblies and vane assemblies (shown schematically) that carry airfoils that extend into the core flow path C. For example, the rotor assemblies can carry a plurality of rotating blades 25, while each vane assembly can carry a plurality of vanes 27 that extend into the core flow path C. The blades 25 of the rotor assemblies create or extract energy (in the form of pressure) from the core airflow that is communicated through the gas turbine engine 20 along the core flow path C. The vanes 27 of the vane assemblies direct the core airflow to the blades 25 to either add or extract energy.

Various components of a gas turbine engine 20, including but not limited to the airfoils of the blades 25 and the vanes 27 of the compressor section 24 and the turbine section 28, may be subjected to repetitive thermal cycling under widely ranging temperatures and pressures. The hardware of the turbine section 28 is particularly subjected to relatively extreme operating conditions. Therefore, some components may require internal cooling circuits for cooling the parts during engine operation.

Figure 1B:
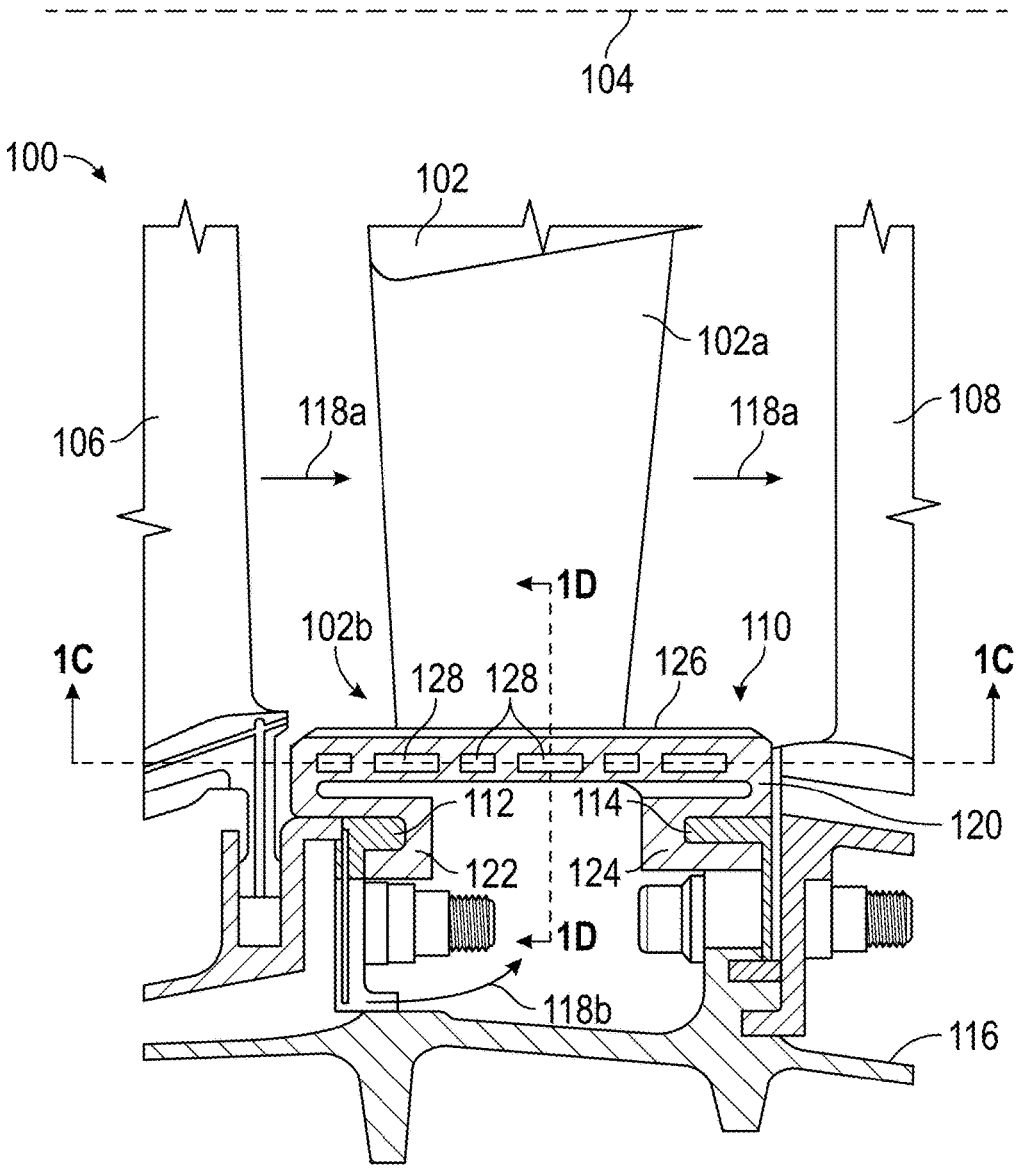
FIG. 1B is a partial axial section view of a gas turbine engine rotor and case assembly including a segmented rotor seal that may employ various embodiments disclosed herein.
Figure 1C:
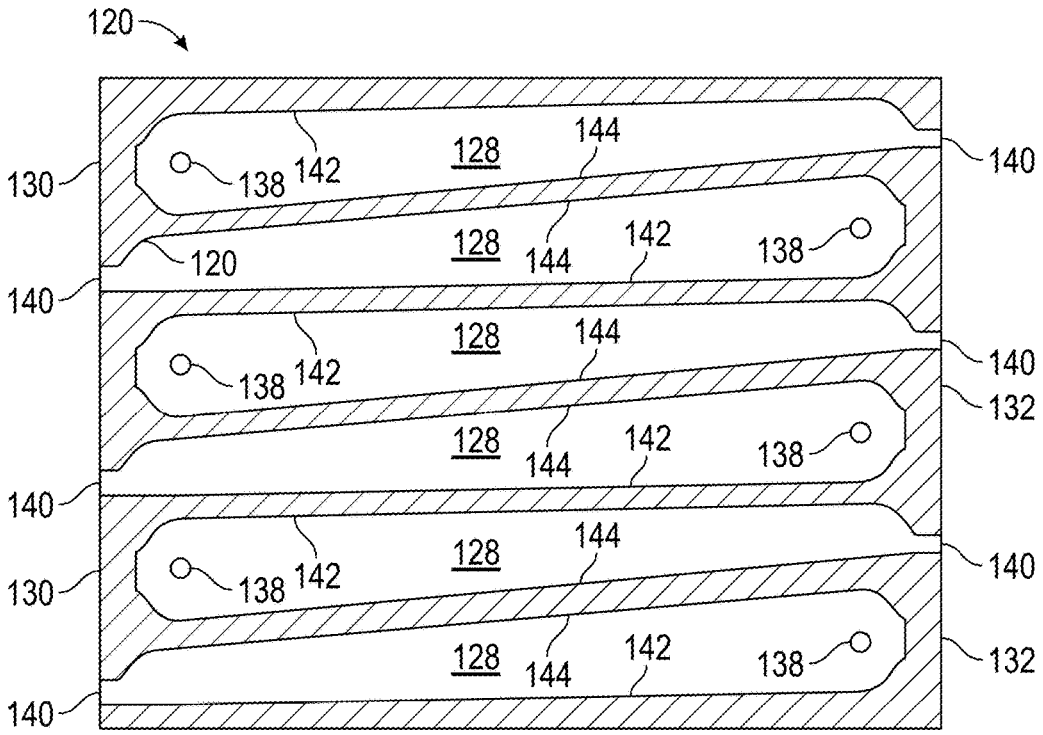
FIG. 1C is a sectional view of the seal of FIG. 1B.
Figure 1D:
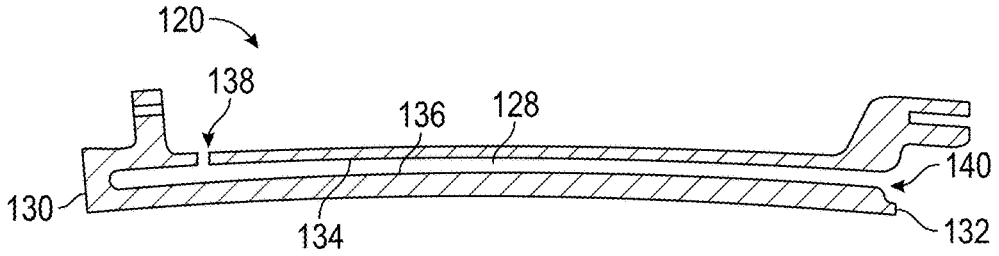
FIG. 1D is an alternative sectional view of the seal of FIG. 1B.

FIGS. 1B-1D are schematic illustrations of a gas turbine engine rotor and case assembly 100. FIG. 1B is a partial axial section view of the gas turbine engine rotor and case assembly 100. FIG. 1C is a sectional view along the line 1C shown in FIG. 1B and FIG. 1D is a sectional view along the line 1D shown in FIG. 1B.

The gas turbine engine rotor and case assembly 100 includes, as shown, a rotor 102, an engine axis of rotation 104, one or more stators 106, 108, a seal 110, one or more supports 112, 114, and a case 116. The rotor 102 may be, for example, a high pressure turbine rotor stage including a circumferential array of blades 102*a* configured to be connected to and rotate with a rotor disc (not shown) about the engine axis 104. Immediately upstream and downstream of rotor 102 are the stators 106, 108, respectively. The stators 106, 108 may be, for example, stationary turbine nozzles including circumferential arrays of vanes configured to guide a working medium fluid 118*a* flow through successive turbine stages, such as through the rotor 102.

Circumscribing a tip 102*b* of the blade 102*a* is the seal 110. The seal 110 may be a rotor seal is connected to the engine case 116 at the supports 112, 114. The seal 110 may include a plurality of arcuate seal segments 120 circumferentially arranged to form an annular ring surrounding the blades 102*a*. Each of the seal segments 120 may include, as shown in FIG. 1B, forward and aft hooks 122, 124, a rub strip 126, and one or more cooling chambers 128. The forward and aft hooks 122, 124 may be configured to mount the seal segment 120 to the supports 112, 114, respectively. The rub strip 126 may be arranged on a radially inner surface of the seal segment 120 adjacent the tip 102*b* of the blade 102*a*.

With reference to FIG. 1C, the cooling chambers 128 may extend generally circumferentially from a first axial inter-segment surface 130 to a second axial inter-segment surface 132 and between a radially outer circumferential or top surface 134 and a radially inner circumferential or bottom surface 136 of seal segment 120.

During engine operation, the blades 102*a* rotate about the engine axis 104, and the seal 110 acts to contain and direct the working medium fluid 118*a* around the blades 102*a*. The blades 102*a* rotate in close proximity with the seal 110 to minimize the amount of working medium fluid 118*a* that escapes a primary flow path into the space between the tip 102*b* of the blade 102*a* and the seal 110. In some cases, the tips 102*b* of the blades 102*a* may contact the seal 110. Each of the seal segments 120 may therefore include the rub strip 126 made from an abradable material, such as a metallic honeycomb strip or a ceramic abradable material, capable of withstanding contact with the blades 102*a*. Because the operating temperatures of the gas turbine engine may exceed the material limits of the seal segments 120, the seal segments 120 may include cooling features, such as the cooling chambers 128. Cooling chambers 128 may be configured to receive cooling fluid, such as compressor bleed air 118*b*, to cool the seal segment 120.

As noted, FIGS. 1C and 1D are section views of the seal segment 120 with cooling chambers 128. FIG. 1C is a circumferential section of seal segment 120 as viewed along the line 1C in FIG. 1B. FIG. 1D is a radial section of seal segment 120 as viewed along the line 1D of FIG. 1D. In FIG. 1C, each of the cooling chamber 128 includes a cooling inlet aperture 138 and a cooling exit aperture 140.

The shape of the cooling chambers 128 is generally defined by a top surface 134, a bottom surface 136, and side surfaces 142, 144 connecting the top surface 134 and the bottom surface 136. The cooling inlet aperture 138 is in flow communication with a coolant supply, such as compressor bleed air 118*b* shown in FIG. 1B and located a first end of the cooling chamber 128. The inlet aperture 138 may be arranged toward a longitudinal center of the cooling chamber 128 as shown. In some alternative embodiments, the inlet apertures may be offset from a center of the cooling chambers. The cooling exit aperture 140 is in flow communication with a second end of cooling chamber 128 and, for example, a space between adjacent seal segments 120. As will be appreciated by those of skill in the art, the cooling chambers may include flow obstructions, resupply apertures, textured top and/or bottom surfaces, and/or other features without departing from the scope of the present disclosure.

During engine operation, each of seal segments 120 may be cooled using, for example, the compressor bleed air 118*b* directed to the seal segment 120 through the supports 112, 114. Some of the compressor bleed air 118*b* may enter each of the cooling chambers 128 through the cooling inlet apertures 138, flow through the length of the cooling chamber 128, and exit through the cooling exit aperture 140 to cool axial inter-segment surfaces 130, 132 of adjacent seal segments 120.

As shown in FIG. 1C, the cooling chamber 128 may include side surfaces 142, 144. As shown, a first side surface 142 may be a side surface that is configured parallel to a flow direction, i.e., from the inlet 138 to the exit 140. A second side surface 144 may be tapered or angled with respect to the first side surface 142, i.e., not parallel to the first side surface 142. The cooling chamber 128 may be wider at an inlet end and narrow toward the exit 140, as shown.

Figure 2B:
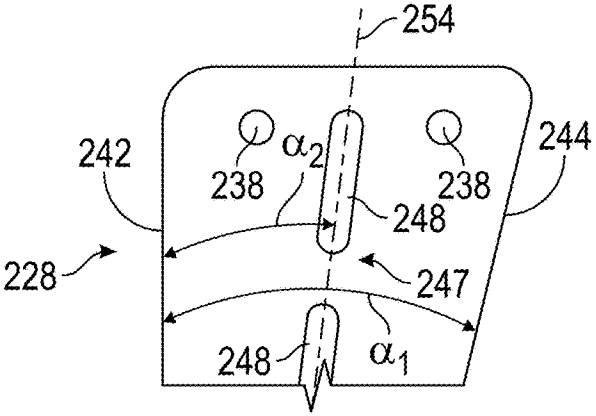
FIG. 2B is an enlarged detailed illustration of the cooling chamber of FIG. 2A.
Figure 2A:
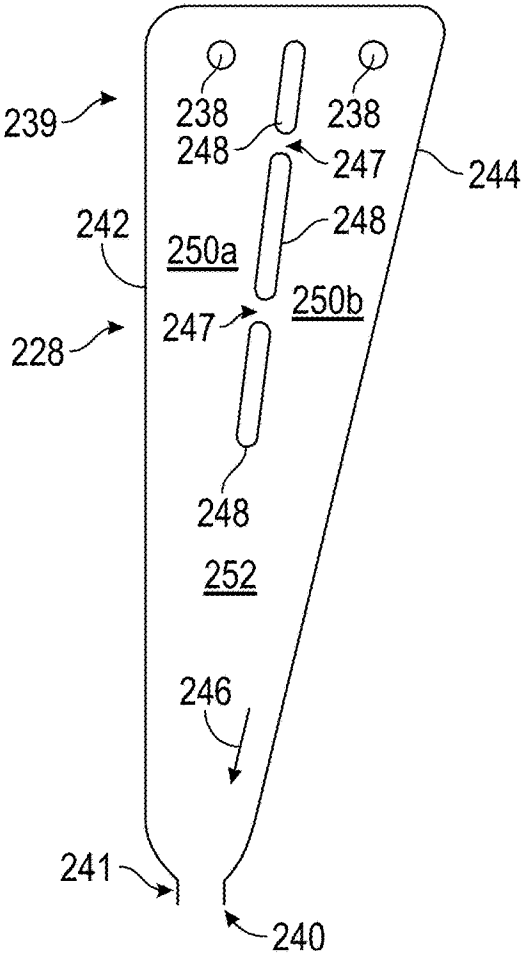
FIG. 2A is a schematic illustration of a cooling chamber in accordance with an embodiment of the present disclosure.

Turning now to FIGS. 2A and 2B, a non-limiting configuration of a cooling chamber 228 in accordance with the present disclosure is shown. FIG. 2B shows an enlarged detail view of the cooling chamber 228. The cooling chamber 228 may be configured within a seal segment, such as shown and described above. A plurality of cooling chambers 228 may be configured within a single seal segment such as shown in FIG. 1C. The cooling chamber 228 includes a first side surface 242 and a second side surface 244 opposing the first side surface. The second side surface 244 may be angled such that the cooling chamber 228 defines a tapered shape, tapering from an inlet end 239 to an outlet end 241. As shown in FIG. 2B, the second side surface 244 may be angled with respect to the first side surface 242 at a first angle $\alpha_1$. Multiple inlets 238 may be configured at the inlet end 239 and an exit 240 may be configured at the outlet end 241, with an airflow passing from the inlets 238 to the exit 240 in a flow direction 246.

The cooling chamber 228 may also include one or more dividers 248 disposed from the inlet end 239 and extending toward the outlet end 241 in the flow direction 246. The dividers 248 are configured to separate the cooling chamber 228 into two or more flow paths. In accordance with embodiments provided herein, holding flow rate constant into and through a cooling chamber, reduced channel heights have higher air velocity and thus higher heat transfer coefficients and frictional losses. Reducing the height to such a point that the aspect rather alters the flow structure (e.g., the number or strength of vortices in the flow) can reduce the heat transfer coefficients or raise frictional losses. The dividers provided herein allow an additional variable to maintain flow structure while reducing cavity heights for baseline heat transfer coefficient improvements.

In some embodiments, the dividers 248 may be integrally formed with the structure of the cooling chamber 228, e.g., in a molding process, such that the dividers 248 and the seal segment are one single component. In other embodiments, the dividers 248 may be separate features that are attached or connected to surfaces in the cooling chamber 228. In some embodiments, the dividers 248 may be solid and in other embodiments the dividers 248 may be hollow, thus enabling a reduction in weight of the seal segment the dividers 248 are formed within. The each of the dividers 248 may be separated by a gap 247. The gap 247 may enable more flexibility to the seal segment to which the cooling chamber 228 is within.

As shown a first flow path 250*a* extends between the dividers 248 and the first side surface 242 and a second flow path 250*b* extends between the dividers 248 and the second side surface 244. The first flow path 250*a* and the second flow path 250*b* may combine or join into a single flow path 252 at the downstream end of the dividers 248.

As shown, the dividers 248 may extend linearly in the flow direction 246 along a divider axis 254. The divider axis 254 may be angled at a second angle $\alpha_2$. The second angle $\alpha_2$ may be configured at a same angle as the first angle $\alpha_1$ or may have a different angle. For example, in some embodiments, the second angle $\alpha_2$ may be half of the first angle $\alpha_1$, such that $\alpha_2=\alpha_1/2$.

Further, as shown, the dividers 248 may, in some configurations, be discrete or separate features within the cooling chamber 228. The length, shape, width, separation between dividers, etc. may be varied or customized to achieve a desired airflow configuration. The dividers 248 enable high tapering angles (e.g., first angle $\alpha_1$) and thus wide cooling chambers 228. As used herein, the width of the cooling chamber 228 is a length in a direction normal to the flow direction 246 or normal to the first side surface 242. That is, in the flow direction 246, the cooling chamber 228 narrows in width from the inlet end 239 to the outlet end 241.

Figure 3B:
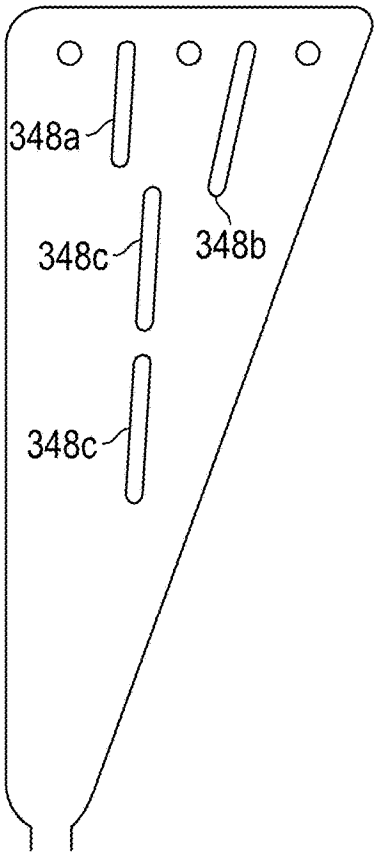
FIG. 3B is a variation on the embodiment shown in FIG. 3A.
Figure 3A:
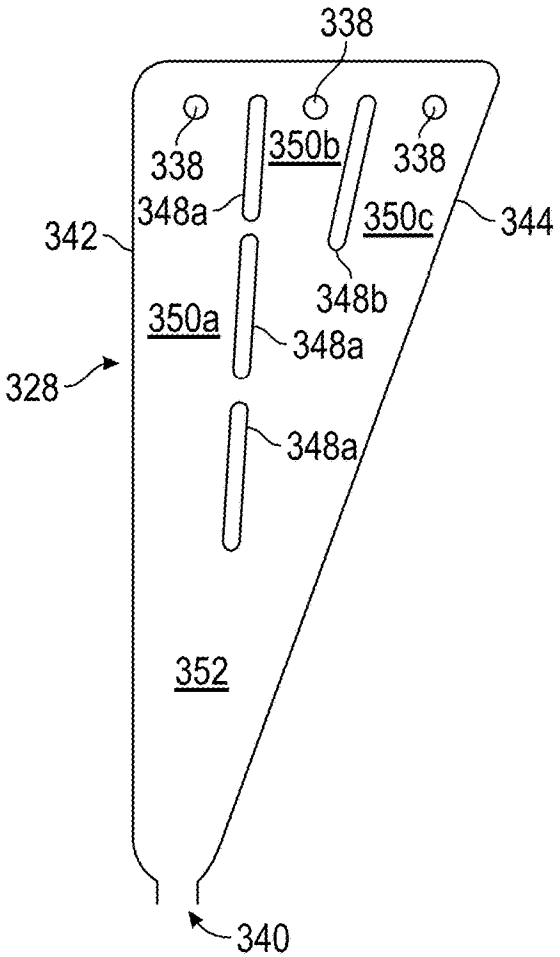
FIG. 3A is an alternative embodiment of a cooling chamber in accordance with an embodiment of the present disclosure.

Turning now to FIG. 3A, an alternative configuration of a cooling chamber in accordance with the present disclosure is shown. As shown, the cooling chamber 328 includes three inlets 338. Each inlet 338 is separated from an adjacent inlet 338 by one or more dividers 348. Accordingly, each inlet 338 has an associated flow path therewith, extending from the respective inlet 338 toward the exit 340 of the cooling chamber 328. As shown, a first flow path 350*a* is bounded by the first side surface 342 and a first set of dividers 348*a*. A second flow path 350*b* is bounded by the first set of dividers 348*a* and a second set of dividers 348*b* (as shown, there is one divider 348*b* in the second set). A third flow path 350*c* is bounded by the second set of dividers 348*b* and the second side surface 344 of the cooling chamber 328. As shown, each of the flow paths 350*a*, 350*b*, 350*c* are joined downstream into a single flow path 352 prior to exiting the cooling chamber 328 at the exit 340. As will be appreciated by those of skill in the art, any number of inlets and/or sets of dividers may be employed without departing from the scope of the present disclosure. Additional divider sets may enable wider cooling chambers.

FIG. 3B shows an alternative configuration similar to that shown in FIG. 3A. In the configuration of FIG. 3B, the first and second set of dividers 348*a*, 348*b* are the same proximal to the inlets. However, a third set of dividers 348*c* are provided that are offset from either of the first divider 348*a* or the second divider 348*b*. That is, as shown in this configuration, the sets of dividers are not required to be aligned. Further, as is apparent from the configuration of FIG. 3B, proximal to the inlets there may be a different number of flow paths than at a position that is downstream from the inlets. Thus, as shown in FIG. 3B, at the inlet end of the cooling chamber there may be a first number of flow paths (as shown, three), and then in the middle or downstream from the inlets there may be a different number of flow paths (as shown, two), and toward the exit a different number of flow paths may be present (as shown, one). Thus, the number of flow paths may vary throughout the length of the cooling chamber. Further, as will be appreciated by those of skill in the art, although the number of flow paths decreases moving in the downstream direction, this is not limiting, and the number of flow paths may increase when moving downstream along the cooling chamber.

Figure 4:
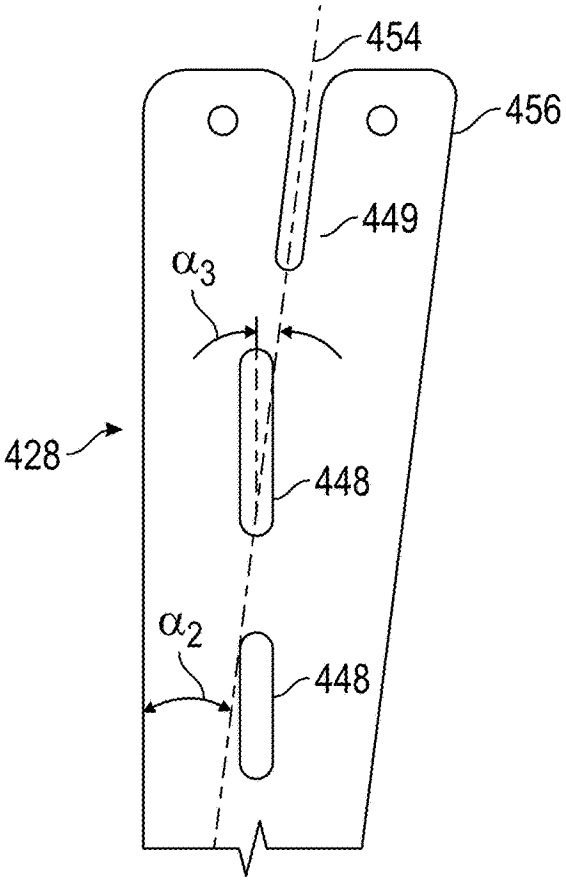
FIG. 4 is an alternative embodiment of a cooling chamber in accordance with an embodiment of the present disclosure.

Turning now to FIG. 4, an alternative configuration of dividers within a cooling chamber in accordance with an embodiment of the present disclosure is shown. In FIG. 4, the cooling chamber 428 includes multiple dividers 448, 449 extending generally along a divider axis $\alpha_2$. However, as shown, some of the divider 448 may be misaligned from the divider axis $\alpha_2$ by a misalignment angle $\alpha_3$. Also shown in the embodiment of FIG. 4 is a divider 449 that is connected to an end wall 456 of the cooling chamber 428. Further, as shown in FIG. 4, some or all of the dividers may be offset from each other with respect to the divider angle $\alpha_2$.

Figure 5B:
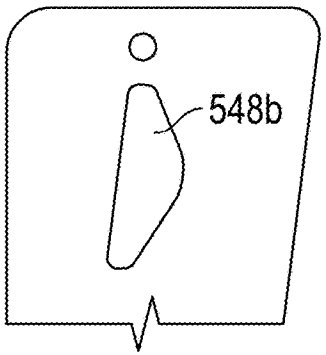
FIG. 5B is a schematic illustration of an alternative configuration of a divider in accordance with an embodiment of the present disclosure.
Figure 5A:
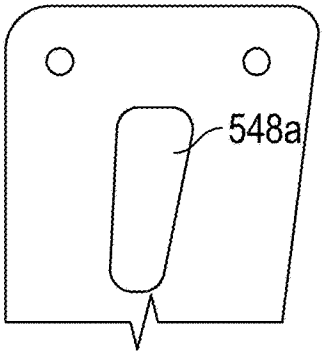
FIG. 5A is a schematic illustration of a divider in accordance with an embodiment of the present disclosure.

Turning now to FIGS. 5A and 5B, alternative configurations of dividers in accordance with embodiments of the present disclosure are shown. In FIG. 5A, the divider 548*a* have an oblong geometry such that the divider 548*a* is wider at the inlet side along the flow direction and narrower toward the outlet. That is, the divider 548*a* may be tapered. In FIG. 5B the divider 548*b* may have a varying thickness along the flow direction. As will be appreciated by those of skill in the art, the dividers may take any desired geometry or shape, without departing from the scope of the present disclosure.

As will be appreciated by those of skill in the art, during manufacture, the cooling chambers of the seal segments may be formed with the dividers as described herein. The seal segments may be manufactured using various techniques including extrusion molding, molding, additive manufacturing, etc. The manufacturing techniques may include forming dividers as described above, having any combination and/or variations on the above described dividers.

Advantageously, embodiments described herein provide improved cooling chambers within seal segments of a gas turbine engine. For example, dividers as described herein may enable wider cooling chambers which may improve overall cooling effectiveness of cooling air. Further, embodiments described herein may enable cooling chambers with high tapering angles that will not violate aspect ratio criteria. Furthermore, the higher tapering angles may improve overall cooling effectiveness of the cooling chamber and thus less cooling air may be required. Further, due to improved cooling, the service life of the seal segments may be extended as component temperatures will be lower. Increased cooling in seals according to the present disclosure may reduce the risk of material failures due to thermo-mechanical stress on the seals and may generally increase engine operating efficiency, both of which may reduce costs associated with operating and maintaining engines.

Further, advantageously, because dividers as described herein may enable wider, tapered cooling chambers while maintaining low heights, thus height-to-width ratios may be maintained at desired levels such that improved cooling is effected in a cooling chamber.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the spirit and scope of the present disclosure. Additionally, while various embodiments of the present disclosure have been described, it is to be understood that aspects of the present disclosure may include only some of the described embodiments.

For example, although discrete examples of dividers are shown in the various disclosed and illustrated embodiments, those of skill in the art will appreciate that any combination and/or alteration on the dividers may be made without departing from the scope of the present disclosure. In some embodiments, multiple sets of dividers may be configured with tapering dividers and/or variable width dividers. Further, in some embodiments, three or more sets of dividers may be employed to enable more flow paths at the inlet end of the cooling chambers.

Further, although shown with circular inlets, those of skill in the art will appreciate that the inlet may take any shape, size, and/or geometry. Thus, in some embodiments, a single inlet may be provided with multiple flow paths separated by dividers as described herein. For example, in one non-limiting example, a larger, oblong inlet may be provided that supplies air into two separate flow paths that are separated by one or more dividers. In other embodiments, a single inlet may be provided that is configured to supply sufficient airflow, and may be a single, circular inlet.

Moreover, as shown and described herein, the seal segment is part of a seal of a rotor seal. However, those of skill in the art will appreciate that the dividers described herein may be used in any type of cooling chamber that it may be desired to decrease a dimension of the cooling chamber. Thus, for example, dividers as described herein may be used in vanes, rotating blades, stators, rotor blades, etc. As such, the thickness or another dimension of a cooling chamber may be minimized while maintaining proper thermal transfer characteristics.

Accordingly, the present disclosure is not to be seen as limited by the foregoing description, but is only limited by the scope of the appended claims.

What is claimed is:

1. A cooling chamber in a gas turbine engine, the cooling chamber comprising:

a first side surface, a second side surface opposing the first side surface, a bottom surface, and a top surface opposing the bottom surface, the surfaces defining a chamber therebetween, the second side surface angled at a first angle with respect to the first side surface, the chamber having an inlet end and an exit located downstream of the inlet end, wherein the chamber has a width that narrows from the inlet end toward the exit;

an inlet located in one of the top surface or the bottom surface at the inlet end of the chamber; and two or more dividers located within the chamber, the two or more dividers dividing the chamber into a first flow path and a second flow path, the first flow path separated from the second flow path by the two or more dividers, wherein the two or more dividers extend in a direction from the inlet toward the exit and the first flow path and the second flow path combine into a single flow path at a downstream end of the two or more dividers, wherein at least one of the two or more dividers is angled at a second angle with respect to the first side surface, wherein the inlet is a first inlet, the cooling chamber further comprising a second inlet located adjacent the first inlet at the inlet end of the chamber, wherein the two or more dividers are located between the first inlet and the second inlet and an airflow from the first inlet provides air into the first flow path and the second inlet provides air into the second flow path, and a third inlet located adjacent the second inlet at the inlet end, wherein two or more first dividers are located between the first inlet and the second inlet and at least one second divider is located between the second inlet and the third inlet.

2. The cooling chamber of claim 1, wherein the two or more dividers comprise a first divider and a second divider.

3. The cooling chamber of claim 2, wherein the first divider and the second divider are aligned in a direction extending from the inlet toward the exit, wherein a gap separates the first divider from the second divider.

4. The cooling chamber of claim 3, wherein the first divider and the second divider are offset from the second angle by a misalignment angle.

5. The cooling chamber of claim 1, wherein the second angle is equal to half of the first angle.

6. The cooling chamber of claim 1, wherein at least one divider of the two or more dividers extends from an end wall of the chamber at the inlet end of the chamber.

7. The cooling chamber of claim 1, wherein at least one divider of the two or more dividers tapers in a direction extending from the inlet end to the exit.

8. The cooling chamber of claim 1, wherein at least one divider of the two or more dividers has a varying thickness along a direction extending from the inlet end to the exit.

9. The cooling chamber of claim 1, wherein the chamber is a cooling chamber of a seal of a blade outer air seal of the gas turbine engine.

10. A method of forming a cooling chamber for a gas turbine engine, the method comprising:

forming a chamber defined by a first side surface, a second side surface opposing the first side surface, a bottom surface, and a top surface opposing the bottom surface, the second side surface angled at a first angle with respect to the first side surface, the chamber having an inlet end and an exit located downstream of the inlet end, wherein the chamber has a width that narrows from the inlet end toward the exit;

forming an inlet located at the inlet end of the chamber; and forming two or more dividers located within the chamber, the two or more dividers dividing the chamber into a first flow path and a second flow path, the first flow path separated from the second flow path by the two or more dividers, wherein the two or more dividers extend in a direction from the inlet toward the exit and the first flow path and the second flow path combine into a single flow path at a downstream end of the two or more dividers, wherein at least one of the two or more dividers is angled at a second angle with respect to the first side surface, wherein the inlet is a first inlet, the method further comprising forming a second inlet located adjacent the first inlet at the inlet end of the chamber, wherein the two or more dividers are formed between the first inlet and the second inlet and an airflow from the first inlet provides air into the first flow path and the second inlet provides air into the second flow path, and forming a third inlet adjacent the second inlet at the inlet end, wherein two or more first dividers are formed between the first inlet and the second inlet and at least one second divider is formed between the second inlet and the third inlet.

11. The method of claim 10, further comprising forming the chamber in a seal segment of a gas turbine engine.

12. The method of claim 10, wherein forming the two or more dividers comprises forming a first divider and a second divider in the chamber.

13. The method of claim 12, wherein the first divider and the second divider are aligned in a direction extending from the inlet toward the exit, wherein a gap separates the first divider from the second divider.

14. The method of claim 12, wherein the first divider and the second divider are offset from the second angle by a misalignment angle.

15. The method of claim 10, wherein the second angle is equal to half of the first angle.

16. The method of claim 10, wherein at least one divider of the two or more dividers extends from an end wall of the chamber at the inlet end of the chamber.

* * * * *